US012747874B2

(12) United States Patent
Sullivan

(10) Patent No.: US 12,747,874 B2
(45) Date of Patent: Sep. 29, 2026

(54) FRESH WATER EVAPORATIVE COOLING SYSTEM

(71) Applicant: William Sullivan, Twinsburg, OH (US)

(72) Inventor: William Sullivan, Twinsburg, OH (US)

(73) Assignee: BESSAMAIRE SALES, INC., Twinsburg, OH (US)

( * ) Notice: Subject to any disclaimer, the term of this patent is extended or adjusted under 35 U.S.C. 154(b) by 43 days.

(21) Appl. No.: 18/632,205

(22) Filed: Apr. 10, 2024

(65) Prior Publication Data

US 2024/0337396 A1 Oct. 10, 2024

Related U.S. Application Data

(60) Provisional application No. 63/458,435, filed on Apr. 10, 2023.

(51) Int. Cl.

| | |
|---|---|
| ***F24F 5/00*** | (2006.01) |
| ***F28C 3/08*** | (2006.01) |
| ***F28F 25/00*** | (2006.01) |

(52) U.S. Cl.

CPC ..... *F24F 5/0035* (2013.01); *F28C 3/08* (2013.01); *F28F 25/00* (2013.01)

(58) Field of Classification Search

CPC ..... F24F 5/0035; F24F 1/0007; F24F 1/0059; F28C 3/08; F28C 25/00; Y02B 30/54

See application file for complete search history.

(56) References Cited

U.S. PATENT DOCUMENTS

| | | | | | |
|---|---|---|---|---|---|
| 4,045,523 | A * | 8/1977 | Goettl | F28C 1/04 | 261/106 |
| 4,080,410 | A * | 3/1978 | Goettl | F28C 1/04 | 220/678 |
| 2003/0136143 | A1* | 7/2003 | Johnson | F24F 5/0035 | 62/304 |
| 2009/0053040 | A1* | 2/2009 | Chillar | F02C 3/305 | 415/116 |
| 2013/0106004 | A1* | 5/2013 | Stumphauzer | F24F 6/04 | 261/127 |
| 2013/0227974 | A1* | 9/2013 | Kirks | E04H 4/129 | 62/515 |
| 2019/0107344 | A1* | 4/2019 | Rede | F28F 25/06 | |
| 2022/0325965 | A1* | 10/2022 | Bowman | F28G 9/00 | |

FOREIGN PATENT DOCUMENTS

| | | | | |
|---|---|---|---|---|
| CA | 2300234 C | * | 8/2004 | F28C 1/14 |
| CA | 2548699 A1 | * | 8/2007 | F24F 11/77 |
| CN | 218097303 U | * | 12/2022 | |
| JP | 2008032302 A | * | 2/2008 | |
| JP | 2010216708 A | * | 9/2010 | |

* cited by examiner

*Primary Examiner* — Kun Kai Ma

(74) *Attorney, Agent, or Firm* — Lorri W. Cooper; Cooper & Maersch LLC

(57) ABSTRACT

An evaporative cooling system includes an inlet, an outlet, a cooling module and a fan. The inlet is for accepting hot air and the outlet is for expressing air that has a temperature that is lower than the hot air. The cooling module is positioned in the vicinity of the inlet and incorporates a substantially vertical evaporative media and a spray nozzle positioned at a bottom end of the evaporative media. The spray nozzle sprays water upwardly and air flow from the fan causes the water from the spray nozzle to wet the evaporative media.

20 Claims, 5 Drawing Sheets

FRESH WATER EVAPORATIVE COOLING SYSTEM

CROSS-REFERENCE TO RELATED APPLICATION

This application claims priority to U.S. Provisional Application No. 63/458,435, filed on Apr. 10, 2023, the disclosure of which is incorporated herein by reference in its entirety.

FIELD

The present invention concerns an improved evaporative cooling system that utilizes fresh water that is sprayed upwardly onto an evaporative media.

BACKGROUND

An evaporative air cooler is a type of air conditioning device that works by harnessing the power of evaporation to cool air temperatures. When water evaporates, it turns from liquid to gas. When this occurs, the highest energy particles leave the water first. This leads to a drop in temperature. Evaporative cooling systems can be used in commercial or residential buildings and are an economical way to cool air.

In general, prior art evaporative coolers consist of a fan, a thick evaporative media, a water reservoir and a control system. The fan draws dry, hot air into the machine and across the media. The media absorbs the water that is pumped from the water reservoir typically to a top end of the media. Evaporative media has many layers to increase the surface area for evaporation. As the outdoor air passes over the water-saturated media, the water molecules on the surface evaporate, which causes the air temperature inside the cooler to drop. The fan then blows that cold air into the space to be cooled. Evaporative coolers can lower the temperature of the air by around 15° F. to 40° F.

There are three complex mechanical and chemical processes taking place in an evaporative cooler. The first process is the air system, which is illustrated by a psychrometric chart, and the efficiency of the media. The second process is the water delivery system that has to ensure that the media has sufficient water for evaporation and that the media is uniformly wetted. The third process is the water chemistry system where the water for evaporation is controlled so that the naturally occurring dissolved solids in the water remain in solution and are disposed of prior to being deposited on the media.

In evaporative cooling applications, the movement of the heat from the air to the water vapor happens without a change in air volume or air pressure and results in a lowering of the temperature of the air. The relationships between pressure, temperature, humidity, density and heat content are most commonly shown graphically on Psychrometric charts. These relationships are very well defined and have been the subject of extensive research.

Psychrometric charts, such as that shown in FIG. 1, are complex graphs that can be used to assess the physical and thermodynamic properties of gas-vapor mixtures at a constant pressure. They are often used to assess the properties of moist air. This can be useful in the design of heating, ventilation and air-conditioning systems for buildings. Psychrometric charts often include a zone in the middle that represents the range of conditions that people find comfortable under different circumstances (such as summer and winter).

If one knows the entering air temperature (inlet dry bulb), the relative humidity of the inlet air, the barometric pressure and the volume of air being cooled, it is possible to calculate the theoretical amount of moisture that can be evaporated into the air stream, and the resulting temperature reduction. The chart of FIG. 1 shows an example of a reduction in temperature associated with the use of direct evaporative cooling, which in the example shown results in a reduction of about 20° F.

There are two types of evaporative cooling, which can be used together or separately. In direct evaporative cooling, air flow enters the evaporative media at an approximately 90° angle and travels through the media from front to back. In indirect evaporative cooling, air flows through the evaporative media from the bottom to the top in a parallel manner through the media.

The efficiency of an evaporative cooler is determined by the air flow rate over the chosen medium. Each media type has physical characteristics that determine how fast and thoroughly the water can evaporate into the airstream. The most common evaporative cooling media in use today is a corrugated kraft type paper. Depending on the thickness of the media used and the velocity of the air flowing through the media, the saturation effectiveness (efficiency) can range from less than 60% to about 98 or 99%.

To obtain maximum evaporation, the media must be adequately wetted. Most conventional evaporative coolers have a large basin or reservoir filled with water that is pumped to a perforated header pipe at the top of the media. The water is sprayed from a header pipe up to a deflector shield and runs down onto the top of the media. Excess water is applied to ensure saturation of the media. Any water that is not evaporated drains into the reservoir to be reused. Manufacturers recommend that a portion of the recirculating water be discarded by draining it off and replacing it with fresh water that is added to the reservoir to keep the water quality at a minimum quality level. The distribution header pipe uses relatively large holes that are spaced apart to minimize debris fouling and plugging the pipe. The end result is uneven water distribution and occasionally dry strips on the media. This is often attempted to be overcome by pumping an excessive amount of water to the media, but this can cause the media to deteriorate more quickly. Water in the reservoir is typically at room temperature.

It is known to use a single pass water distribution system that provides water to the top of the media and allows it to flow through the media, and the flow is then drained at the bottom. The flow of water must be properly metered to wet the entire media and a control system is used to control the delivery of liquid. The control system may use a timer to regulate water flow or a temperature sensor within the media coupled to a timer to control the flow of water. However, these systems are not widely commercially acceptable because they use too much water, due to insufficient delivery of water to the media, or due to scaling issues.

Evaporative cooling is economical, environmentally friendly, and healthy. Evaporative cooling is economical because it reduces electricity consumption by nearly 60-80% compared to refrigerated air conditioning and cuts mechanical cooling costs by 25% to 65%. Evaporative cooling becomes more effective as the temperature increases and works in all areas of the country, not just in hot, dry climates.

FIG. 2 depicts a schematic of a prior art direct evaporative cooling process, showing air entering a front side 2 of a wetted media 4 and exiting through the rear side 6 of the wetted media 4. FIG. 3 depicts a schematic of a prior art direct evaporative cooling system that incorporates an enclosure 8 having an air inlet 10 and an air outlet 12. An evaporative media 4 is positioned at the inlet 10 and a fan 14 is positioned between the evaporative media 4 and the air outlet 12. A water tank 16 is positioned below the evaporative media 4 and one or more water inlets 18 is positioned above the evaporative media 4. The water inlet(s) 18 transfer water from the water tank 16 via the pump 20 to the top 22 of the evaporative media 4 where the water flows through the evaporative media 4 back into the water tank 16. Warm air enters the system through the inlet 10 and cooler air exits through the outlet 12.

SUMMARY

According to the invention, an evaporative cooling system includes an inlet and an outlet, a cooling module and a fan. The inlet is for accepting hot air and the outlet is for expressing air that has a temperature that is lower than the hot air. The cooling module is positioned in the vicinity of the inlet incorporating a substantially vertical fresh water evaporative media having a front hot surface and a rear cold surface, and a spray nozzle positioned at a bottom end of the fresh water evaporative media, with an opening of the spray nozzle pointing upwardly. The fan is for moving air through the fresh water evaporative media. The spray nozzle is coupled to a fresh water source and sprays water upwardly. Air flow from the fan causes the water from the spray nozzle to wet the fresh water evaporative media. Water is not recirculated.

The system may also include a motor and a controller. The motor is for driving the fan. The controller is for controlling the spray nozzle to permit the spray nozzle to spray water in front of the fresh water evaporative media between the inlet and the front hot surface of the fresh water evaporative media.

The spray nozzle may spray fluid in a fan-shaped pattern or a substantially fan-shaped pattern. The spray nozzle may be a Teflon spray nozzle. The spray nozzle may spray fluid in a fan-shaped 120° pattern and water may be sprayed onto the fresh water evaporative media constantly during operation.

The system includes a cold, clean water source coupled to the spray nozzle for spraying clean, cold water upwardly adjacent the hot side of the fresh water evaporative media. The clean, cold water may have an untreated water temperature of about 45° to 60° F. The spray nozzle may spray upwardly in substantially parallel relation to the front hot surface of the fresh water evaporative media. The fresh water evaporative media may be a pad-like material.

The spray nozzle may be centered at the bottom of the fresh water evaporative media. The spray nozzle may be spaced about 7 inches in front of the fresh water evaporative media.

In another embodiment, an evaporative cooling module for use with an evaporative cooling system includes an evaporative media, a frame, a sealing mechanism, and a spray nozzle. The evaporative media is positioned substantially vertically for permitting air to flow through the evaporative media. The frame is for holding the evaporative media in a vertical position in the cooling module. The sealing mechanism is for sealing around a periphery of the evaporative media in the frame so that air is deterred from traveling around the periphery of the evaporative media. The spray nozzle is positioned at the bottom of the evaporative media for spraying water upwardly in front of the evaporative media.

The spray nozzle may be centered at the bottom of the evaporative media. The spray nozzle may be positioned below the evaporative media. The system may also include a door positioned on a side surface of the frame for accessing the evaporative media. The system may also include a solenoid that opens and closes when instructed to do so to permit water to flow through the spray nozzle. The spray nozzle may be made at least in part of Teflon. The spray nozzle may be shaped to spray in a 120° fan shape or another shape. The spray nozzle may be sized to cover the evaporative media with water.

The evaporative media may be a needled, ultra-loft polyester material that is about 1" thick. The evaporative media may be a dual density material, with a density of the downstream side of the media being lower than a density of the upstream side of the media. The fresh water evaporative media may include anti-microbial properties.

The system may cool air to within 2° F. to 5° F. above wet bulb temperature.

DETAILED DESCRIPTION

Figure 1:
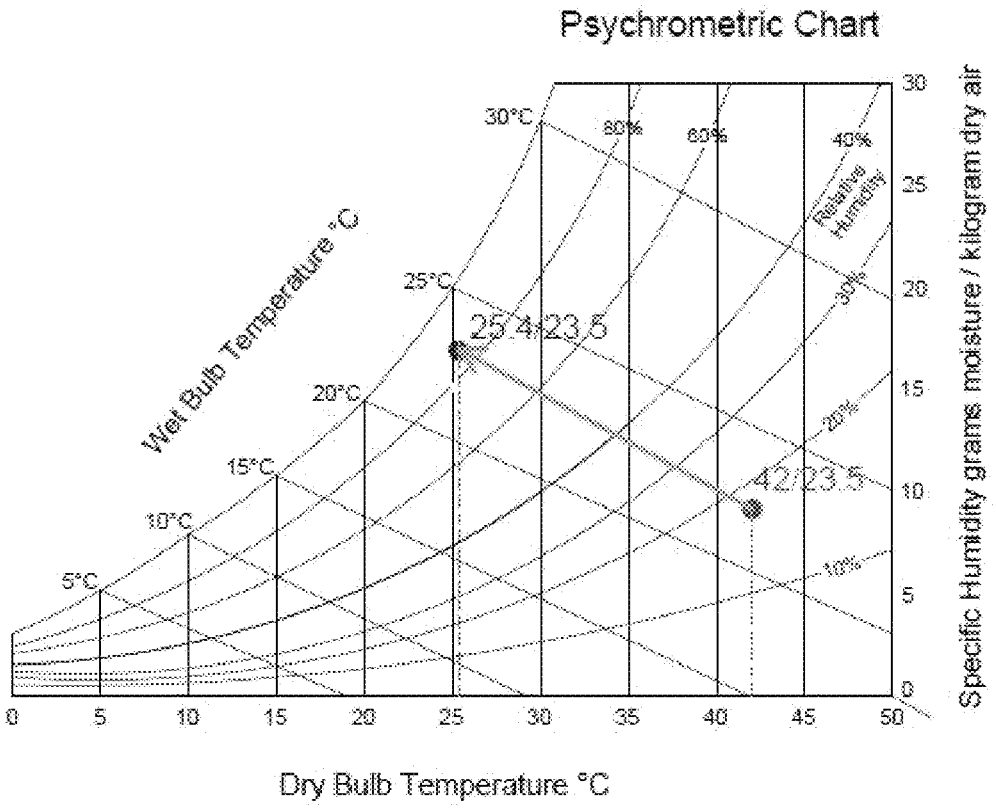
FIG. 1 depicts a psychometric chart showing temperature change associated with a direct evaporative process.
Figure 10:
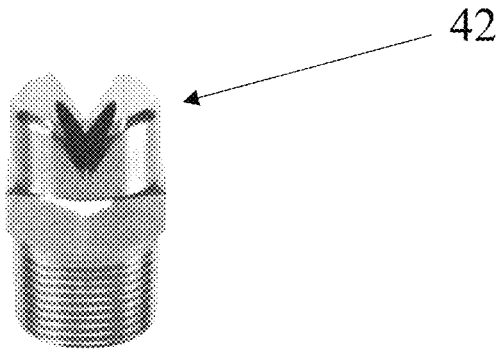
FIG. 10 depicts a spray nozzle for use with the evaporative cooling device of FIGS. 4-9.
Figure 2:
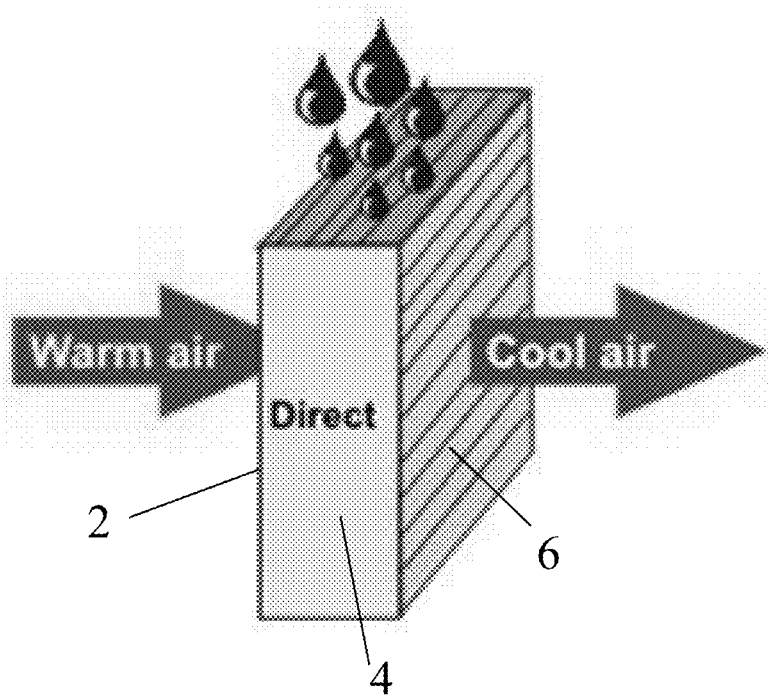
FIG. 2 (Prior Art)
FIG. 2 depicts a schematic of a direct evaporative cooling process.
Figure 3:
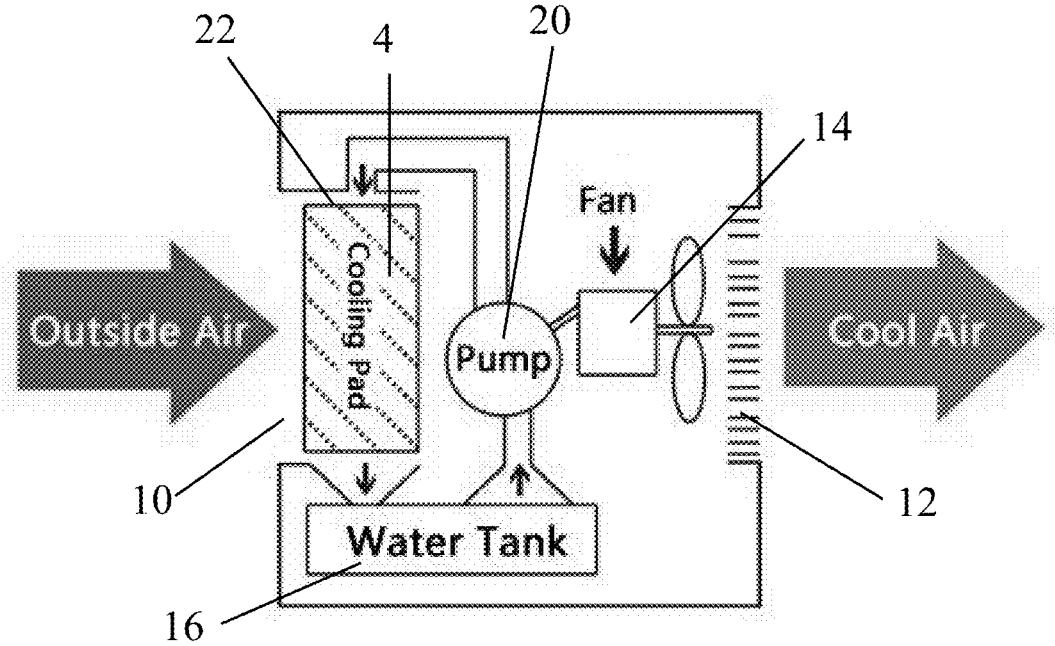
FIG. 3 (Prior Art)
FIG. 3 depicts a schematic of a prior art direct evaporative cooling system.

The present invention is directed to an industrial evaporative cooler 30 that utilizes direct evaporative cooling to lower room temperature. Evaporative cooling works best at higher ambient temperatures. Heat stress occurs when the ambient temperature reaches 81° F. or higher. The present evaporative cooler 30 is designed to keep the ambient temperature in a building at 80° or less.

The example evaporative cooler 30 includes a fresh water evaporative media 32 in the form of a pad or similar member that is positioned in a frame 34. A screen 36 may be positioned over the media 32 to assist in preserving the shape of the media 32 during use. The media 32 utilized with the invention may be a polyester material, a fabric material, a honeycomb material, a paper material, a combination thereof, or any other known materials. Known prior art media 32 in the form of honeycomb material is typically made of cellulose, which provides 80% efficiency when the media 32 is 12" thick and 90% efficiency when the media 32 is 24" thick. A polyester material, as described below, is preferred in the present invention because it provides greater efficiency with a much thinner media 32.

The fresh water evaporative media 32 has a hot side 38, which is the air entrance side, and a cold side 40, which is the air exit side. The media 32 is locked and sealed around the side edges of the frame 34 to prevent the bypass of air around the media 32 so that all outside air flows through the media 32.

Applicant's prior evaporative cooler is shown and described in U.S. Pat. No. 4,640,696 ("'696 patent"), entitled "Apparatus for Cleaning and Conditioning Gas," which issued on Feb. 3, 1987, the disclosure of which is incorporated herein by reference in its entirety. The '696 patent describes the operation of an evaporative cooler, similar to that shown in FIGS. 7-9.

The system is different from typical prior art evaporative coolers in that it uses fresh water and does not utilize a water reservoir. Water is never recirculated, which means that cold water from the local water source is always applied to the cooler 30. The temperature of fresh water from underground water pipes is typically around 45 degrees F. to 60 degrees F. Room temperature water, such as that in the water reservoir is typically around 75°-80° F., depending on the temperature in the unairconditioned room. The present system is advantageous in that it uses cold water that is sprayed onto the fresh water evaporative media 32 of the evaporative cooler 30 to wet the media 32.

Prior art evaporative cooling systems cool to within 2° to 5° above wet bulb on the psychometric chart. Because water that is approximately at 60° F. is applied to the media 32 of the present invention, this permits the system to cool to 3° to 4° below wet bulb. This is unheard of in present day evaporative cooling systems.

When hot air is drawn through the media 32, the cold water sprayed on the media 32 helps to reduce the temperature of the air exiting through the cold side 40 of the media 32 more than if recirculated water was used from a water reservoir. Any water that has not evaporated from the media 32 will eventually travel down the fresh water evaporative media 32 and exit through a drain below the media 32. This system is also advantageous because there is less fouling of the media 32 material because minerals do not build up in a water reservoir.

The fresh water evaporative media 32 may be a MERV 8 evaporative cooling media 32. The media 32 may be a needled, ultra-loft polyester material that has a thickness that is thinner than traditional evaporative cooling media 32. A thinner media 32 of this nature is advantageous because water in the media 32 does not have a chance to warm up as much as it would in a thicker media 32, resulting in the production of lower temperatures than were previously obtained from thicker media 32. Because the media 32 is thinner than prior media 32, water in the media 32 stays cold on the media 32 because it is constantly replenished by the sprayer and only sits on the media 32 for a limited time before it can be evaporated. Because the water does not dwell for long periods of time on them media 32, it has less likelihood of warming up. Colder water on the media 32 helps to lower the temperature of air exiting the evaporative cooling system 30, which results in better cooling properties than previously known.

The media 32 described above holds water longer than prior art media 32 and has a thickness that is approximately 1" thick, which is between 4% and 8% of the thickness of the prior art media 32. Other thicknesses of this nature may be utilized, such as those that are 3% to 10% of the thickness of the prior art media thickness. The media 32 utilized with the present invention may be a dual-density, anti-microbial polyester material with Drytec™ fiber. The Drytec™ fiber may be positioned on the downstream side. 15/45 polyester denier fiber may be utilized on the upstream side 38 and 6/15 polyester denier needled media 32 may be used on the downstream side 40. Because the media 32 is dual density, the material of the media 32 can be less dense on the downstream side and more dense on the upstream side. The material used with the present invention has a greater density than the prior art media, but still permits air to travel through the media efficiently. The media 32 may be treated to be anti-microbial and/or anti-bacterial. The media 32 may include materials that are naturally anti-microbial and/or anti-bacterial.

Advantageously, the fresh water evaporative media 32 is wetted using a spray nozzle 42 that is positioned at the bottom of the evaporative media 32. The spray nozzle 42 sprays upwardly in front of the evaporative media 32 to cover and wet the entire media 32 in a continuous manner. 100% fresh water is constantly sprayed onto the evaporative media 32. Airflow from the fan sucks the water into the media 32. It is not necessary to spray directly onto the media 32 since the airflow moves the water into the media 32. A preferred distance from the media 32 for the location of the spray nozzle 42 is approximately 7 inches. The distance of the spray nozzle 42 from the face of the evaporative media 32 may vary depending upon the size of the system. The spray nozzle 42 is preferably spaced in front of the media 32 a distance. In addition, depending upon the type of spray nozzle 42, it is advantageous to position the spray nozzle 42 in the center of the evaporative media 32 at the bottom end 46 thereof.

The spray nozzle 42 is preferably any type of spray nozzle 42 that can cover the entire shape of the media 32. In one embodiment, the spray nozzle 42 sprays a 120° fan of water. Other spray patterns may alternatively be used, such as a 100° fan spray pattern, a 140° fan spray pattern and intervals above and below these angles of spray pattern. Other non-fan-like spray patterns may also be useful with the invention. The spray nozzle 42 is sized based upon the size of the fresh water evaporative media 32 and is designed to wet the entire media 32. Thus, smaller nozzles are used for smaller evaporative media 32 and larger nozzles are used for larger evaporative media 32.

One type of spray nozzle 42 that may be utilized is made of PTFE and has a ⅜" pipe connection with an M NPT connection time, a spray angle of 120°, a fan spray pattern and a weight of 0.5 oz. Other nozzles may alternatively be utilized. One type of nozzle 42 may be a non-clogging Teflon nozzle 42 that is coupled to Teflon tubing as the water delivery system to the nozzle 42. The Teflon material helps to prevent clogging caused by calcification.

Because airflow through the fresh water evaporative media 32 is used to draw the water from the spray nozzle 42 into the media 32, it is not necessary to direct the flow from the nozzle 42 into the media 32. This permits for a greater coverage area for the spray nozzle 42 because flow of the spray is not impeded by the fresh water evaporative media 32. As discussed, the spray nozzle 42 sprays straight up. Overspray may hit the ceiling 48 of the associated cooling unit 50 and flow down into a drain 76.

The spray nozzle 42 is coupled to a solenoid valve 52 which opens and closes to permit water to enter the spray nozzle 42 or to close the flow of water from the spray nozzle 42, when desired. The solenoid valve 52 is coupled to a bridge and a PLC (Programmable Logic Controller) 54. The PLC 54 tells a relay to open the bridge and to turn on the solenoid valve 52 and to permit water to flow through the spray nozzle 42. An algorithm is used to determine how long electricity flows to the solenoid 52. Flow rate per CFM is determined based upon the size of the system and the system's location. A rate of flow of one (1) gallon of water evaporated per 100 CFM (cubic feet per meter) is typical for Cleveland, Ohio. A rate of flow of two (2) gallons per 1000 CFM is typical for Phoenix, Arizona. Thus, the system may be customized for each location.

A typical cooling module 50 is 5000-20000 CFM. The length of time that the solenoid valve 52 remains open to spray water from the spray nozzle 42 is directly related to the size of the evaporative media 32 and the location of the system. Nozzle flow rate from the spray nozzle 42 is typically gallons per hour and the PLC 54 controls the timing in seconds.

The spray nozzle 42 and the time and frequency of spraying cold water onto the media 32 may be governed by the PLC 54, which may also be coupled to a computer or other controller. The PLC 54 contains an algorithm that, at a given humidity and temperature, determines how long to spray water from the spray nozzle 42 and how much water needs to be evaporated per CFM to lower the temperature by a desired amount. The more water that evaporates, the lower the temperature.

The system utilizes one or more sensors, and the PLC 54 incorporates a timer. Sensors are used to determine the relative humidity (RH) and temperature. The sensors communicate with the PLC 54 to determine how much water to deliver through the spray nozzle 42. The PLC 54 tells the solenoid how much water to deliver.

Figure 4:
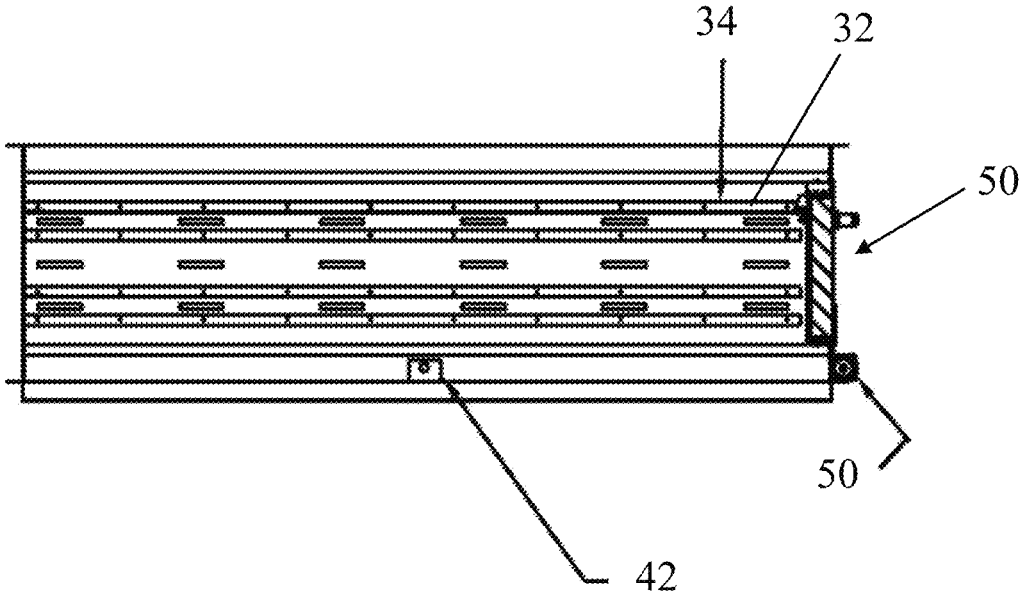
FIG. 4 depicts a top view of a cooling module incorporating an evaporative media device for use with the invention.
Figure 5:
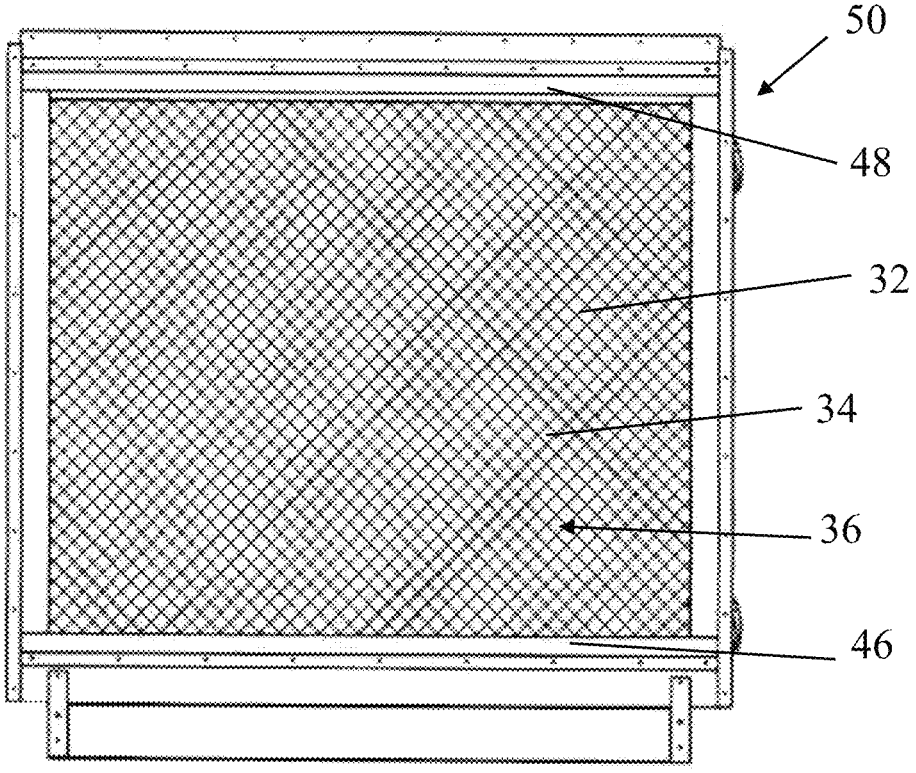
FIG. 5 depicts a front view of the cooling module of FIG. 4 for use with the evaporative cooler of the invention.
Figure 6:
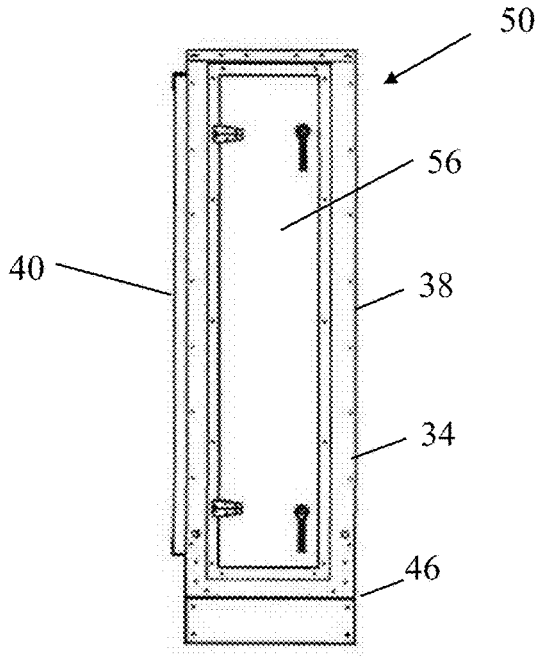
FIG. 6 depicts a side view of the cooling module of FIGS. 4 and 5 for use with the evaporative cooler of the invention.

Referring to the figures, FIGS. 4-6 depict the cooling module of the invention, which incorporates a fresh water evaporative media 32 sealed in the cooling module. The evaporative media 32 is formed as a sheet of material that is positioned vertically or approximately/substantially vertically so that air can flow from a front side 38 (e.g., hot side) through to a rear side 40 (e.g., cold side). The cooling module 50 includes a housing or frame 34 in which the evaporative cooling media 32 is positioned. A nozzle 42 is positioned at the front side of the cooling module and is positioned below or at the bottom of the evaporative media 32. The nozzle 42 is shown as being centered or substantially centered at the bottom of the cooling module and points upwardly. The nozzle 42 is positioned to spray upwardly so that the spray pattern of the nozzle 42 covers the fresh water evaporative media 32. As discussed above, the nozzle 42 may be spaced from the evaporative media 32 by a distance, such as 7 inches. Other distances for spacing may alternatively be utilized. The nozzle 42 sprays substantially vertically and the water emitted by the nozzle 42 contacts the fresh water evaporative media 32 because of a fan 44 that pulls air through the evaporative media 32.

The fresh water evaporative media 32 may be held in position by screening 36 or another mechanism. The screening 36 may be positioned both in front of and behind the evaporative media 32. The cooling module frame surrounds the fresh water evaporative media 32 on four sides and includes sealing members for sealing around the fresh water evaporative media 32 so that hot air cannot escape around the perimeter of the evaporative media 32.

As will be described in greater detail below, the fan 44 pulls hot air along with the spray of water from the nozzle 42 through the fresh water evaporative media 32 where the water evaporates and the air that exits the rear side 40 of the evaporative media 32 is colder than the air that entered the front side 38 of the fresh water evaporative media 32. Any liquid that remains in the fresh water evaporative media 32 flows downwardly along the fibers of the fresh water evaporative media 32 until it drips out of the bottom of the evaporative media 32 and exits through a drain 76 disposed in the bottom of the evaporative cooler 30.

The spray nozzle 42 may be made of Teflon in whole or in part, which helps to deter corrosion of the nozzle 42 so that it can evenly spray fluid therefrom. When hard water or water that has a lot of minerals is used, the fresh water evaporative media 32 is more likely to become fouled with minerals. The cooling module 50 also includes a cooling module access panel 56. The cooling module access panel 56 is positioned on a side surface of the frame and provides access to the fresh water evaporative media 32. Over time, the fresh water evaporative media 32 can become fouled with minerals and dirt and needs to be replaced. The access panel 56 permits the fresh water evaporative media 32 to be more easily replaced. In addition, because the nozzle 42 may become fouled with minerals and, thus, a Teflon nozzle 42 is advantageous to avoid fouling of the nozzle 42.

Figure 7:
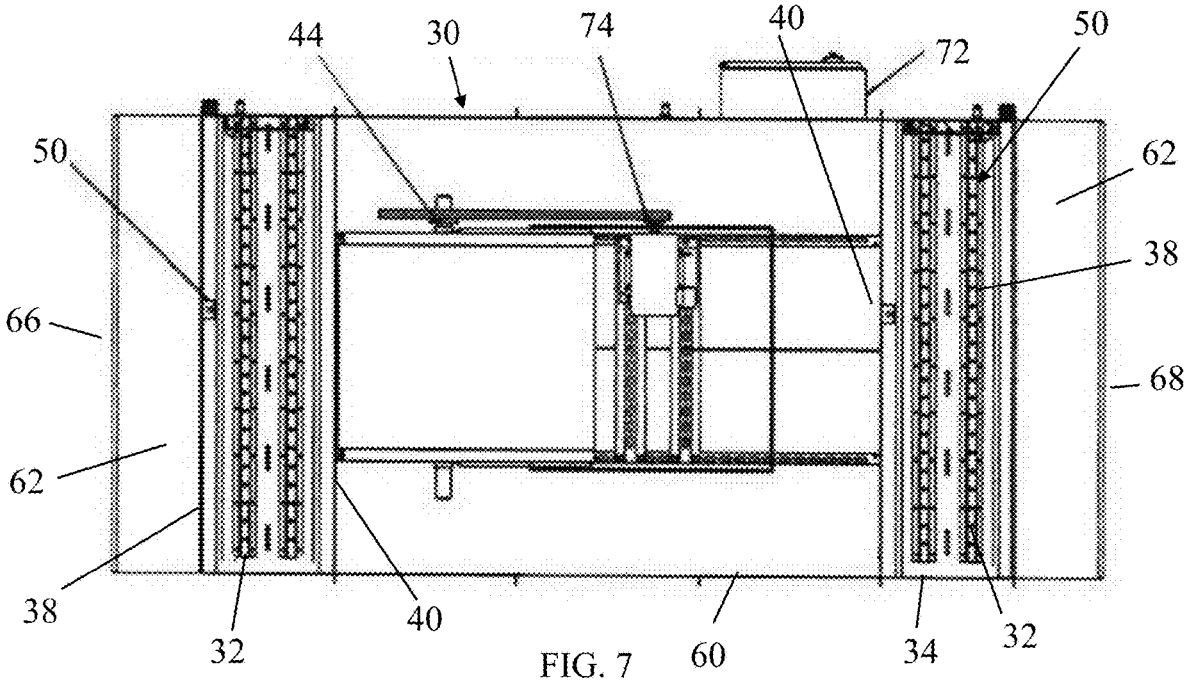
FIG. 7 depicts a top view of an example evaporative cooler according to the invention where two inlets are provided.
Figure 8:
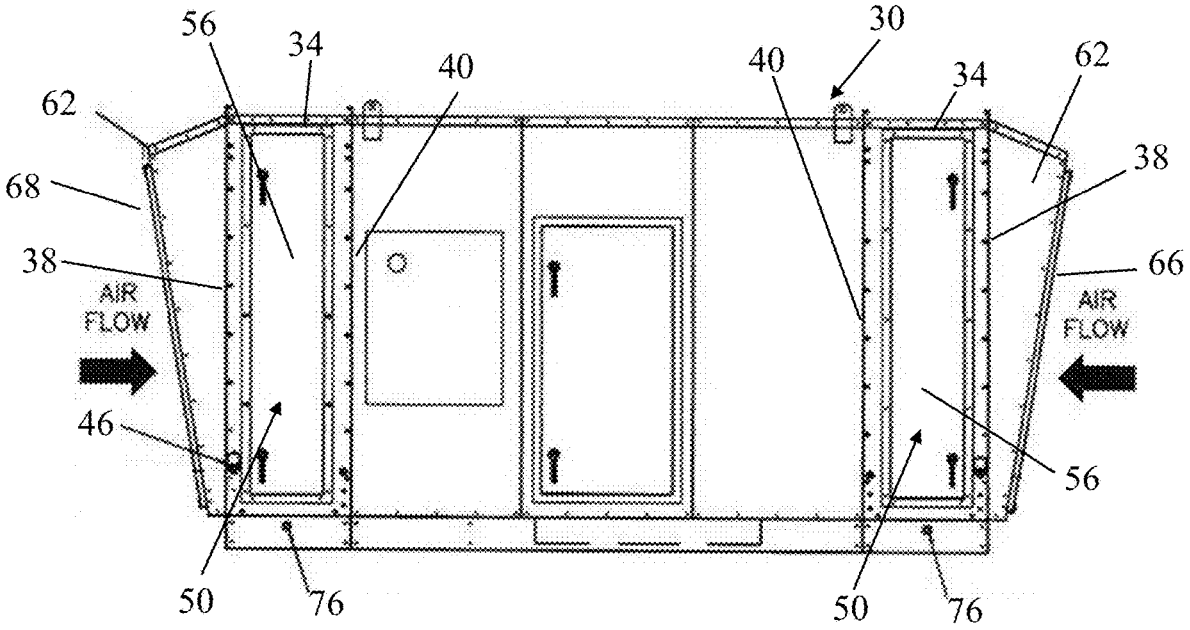
FIG. 8 depicts a side view of the evaporative cooler of FIG. 7.
Figure 9:
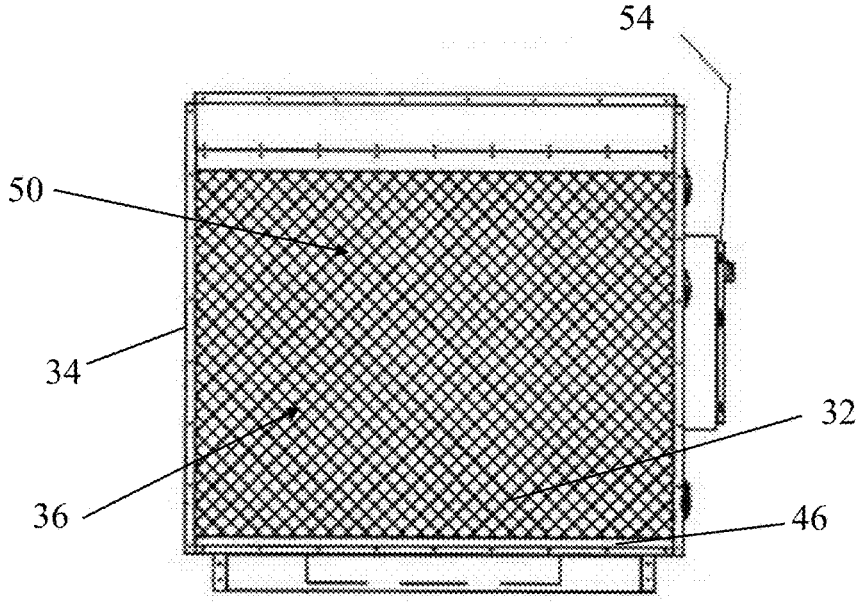
FIG. 9 depicts an end view of the evaporative cooler of FIGS. 7 and 8.

FIGS. 7-9 depict a freshwater evaporative cooling double inlet device 30 having a housing 60. The device 30 shown may have a CFM of, for example, 40,000. The device 30 has a double inlet with a left 66 and a right side 68 and a fresh water evaporative media 32 is positioned at each end of the housing 60. The housing 60 includes a rain hood 62 positioned at each end and the cooling modules 50 are positioned adjacent to the rain hoods 62. The rain hoods 62 may or may not have a prefilter. The prefilter is used to prevent or deter dirt and debris from entering the fresh water evaporative media 32. In the example shown, the evaporative media 32 are placed back-to-back or in tandem, with a blower chamber 70 and a fan 44 positioned between the two cooling modules 50. Air flows inwardly through both ends 66, 68 and exits through an opening that is positioned either in the top or bottom panel (not shown) of the blower chamber 70. An electrical enclosure 72 is positioned on an exterior surface of the housing 60 and is utilized to control the solenoid 46 of the spray nozzle 42, the fan 44, the motor 74, and any other electrical equipment associated with the evaporative cooler 30. A control panel is also associated with the housing 60, either with the control modules 54 or at a separate position on the housing 60. The control module 54 controls the various electrical components of the device 30.

As described above in connection with the control module 54, water is sprayed upwardly and the fan 44 pulls air through the evaporative media 32 where the water evaporates, resulting in lowering of the temperature of the exhausted air. Chilled air is then discharged from the evaporative cooler 30. Access panels 56 are provided to permit servicing of both the fan 44 and the motor 74. In one embodiment, the inlet may be about 70"×70" and the outlet may be about 40"×40". Other dimensions can alternatively be utilized based upon the needed cooling capacity.

Other filters that may be utilized include a wet/dry filter and a prefilter.

The evaporative cooling system 30 may utilize an algorithm to effectively cool air to 3-5° below wet bulb. The algorithm is programmed into the PLC 54. For a 50-60 psi inlet water pressure at 60° F., the following formula may be utilized:

Range 1: When RH<60 TEMP 80° F.-85° F., TIMER 60 SEC OFF, 30 SEC ON

Range 2: When RH<55 TEMP 86° F.-91° F., TIMER 60 SEC OFF, 60 SEC ON

Range 3: When RH<50 TEMP 92° F.-99° F., TIMER 60 SEC OFF, 90 SEC ON

Range 4: When RH<45 TEMP 100° F.-110° F., TIMER 60 SEC OFF, 120 SEC ON

According to the algorithm, based upon the RH and temperature of pre-treated air, the PLC 54 will turn off the spray nozzle 42 for 60 seconds and then turn on the spray nozzle 42 for a predetermined period of time. The temperature may be regulated in any known manner.

The evaporative cooler 30 may be elevated above the floor or may be positioned at ground level. Portable units that incorporate the features discussed herein may also be utilized, where the units are on wheels and may be moved from location to location as needed. A single air inlet and outlet may be utilized along with one or more fresh water evaporative media 32.

While the present disclosure is directed toward an industrial evaporative cooler 30, the technology is equally applicable to residential applications. The embodiment shown in FIGS. 7-9 depicts a dual-sided evaporative cooler 30. An evaporative cooler 30 having a single side may alternatively be used. Multiple fresh water evaporative media 32 may be used in a single evaporative cooler 30 in a side-by-side or other manner, such that multiple media 32 make up a larger evaporative surface.

The term "substantially," if used herein, is a term of estimation. For example, the term substantially can be used to cover manufacturing tolerances and slight variations.

While various features are presented above, it should be understood that the features may be used singly or in any combination thereof. Further, it should be understood that variations and modifications may occur to those skilled in the art to which the claimed examples pertain. The examples described herein are exemplary. The disclosure may enable those skilled in the art to make and use alternative designs having alternative elements that likewise correspond to the elements recited in the claims. The intended scope may thus include other examples that do not differ or that insubstantially differ from the literal language of the claims. The scope of the disclosure is accordingly defined as set forth in the appended claims.

What has been described above includes examples of one or more embodiments. It is, of course, not possible to describe every conceivable modification and alteration of the above devices or methodologies for purposes of describing the aforementioned aspects, but one of ordinary skill in the art can recognize that many further modifications and permutations of various aspects are possible. Accordingly, the described aspects are intended to embrace all such alterations, modifications, and variations that fall within the spirit and scope of the appended claims. Furthermore, to the extent that the term "includes" is used in either the details description or the claims, such term is intended to be inclusive in a manner similar to the term "comprising" as "comprising" is interpreted when employed as a transitional word in a claim. The term "consisting essentially," if used herein, means the specified materials or steps and those that do not materially affect the basic and novel characteristics of the material or method. The articles "a," "an," and "the," should be interpreted to mean "one or more" unless the context indicates the contrary.

What is claimed is:

1. An evaporative cooling system comprising:

an inlet for accepting hot air and an outlet for expressing air that has a temperature that is lower than the hot air;

a cooling module positioned in the vicinity of the inlet incorporating a substantially vertical fresh water evaporative media having a front hot surface and a rear cold surface, and a spray nozzle positioned at a bottom end of the fresh water evaporative media, with an opening of the spray nozzle pointing upwardly; and a fan for moving air through the fresh water evaporative media;

wherein the spray nozzle is coupled to a non-circulating fresh water source and sprays water upwardly and air flow from the fan causes the water from the spray nozzle to wet the fresh water evaporative media; and wherein the evaporative media is a needled, ultra-loft polyester material.

2. The evaporative cooling system of claim 1, further comprising:

a motor for driving the fan; and a controller for controlling the spray nozzle to permit the spray nozzle to spray water in front of the fresh water evaporative media between the inlet and the front hot surface of the fresh water evaporative media.

3. The evaporative cooling system of claim 1, wherein the spray nozzle sprays fluid in a fan-shaped pattern.

4. The evaporative cooling system of claim 1, wherein the spray nozzle sprays fluid in a substantially fan-shaped 120° pattern and water is sprayed onto the fresh water evaporative media constantly during operation.

5. The evaporative cooling system of claim 1, further comprising a cold, clean water source coupled to the spray nozzle for spraying clean, cold water upwardly adjacent the hot side of the fresh water evaporative media.

6. The evaporative cooling system of claim 5, wherein the clean, cold water has an untreated water temperature of about 45° to 60° F.

7. The evaporative cooling system of claim 1, wherein the spray nozzle sprays upwardly in a substantially parallel relation to the front hot surface of the fresh water evaporative media.

8. The evaporative cooling system of claim 1, wherein the spray nozzle is centered at the bottom of the fresh water evaporative media.

9. The evaporative cooling system of claim 1, wherein the spray nozzle is spaced about 7 inches in front of the fresh water evaporative media.

10. The evaporative cooling system of claim 1, wherein the evaporative cooling system cools air to within 2° F. to 5° F. above wet bulb temperature.

11. The evaporative cooling system of claim 1, wherein the fresh water evaporative media includes anti-microbial properties and the fresh water evaporative media is a pad-like material.

12. An evaporative cooling module for use with an evaporative cooling system comprising:

an evaporative media positioned substantially vertically for permitting air to flow substantially horizontally through the evaporative media;

a frame for holding the evaporative media in a vertical position in the evaporative cooling module;

a sealing mechanism for sealing around a periphery of the evaporative media in the frame so that air is deterred from traveling around the periphery of the evaporative media; and a spray nozzle positioned at the bottom of the evaporative media for spraying water upwardly in front of the evaporative media, wherein the evaporative media is a needled, ultra-loft polyester material.

13. The evaporative cooling module of claim 12, wherein the spray nozzle is centered at the bottom of the evaporative media.

14. The evaporative cooling module of claim 12, wherein the spray nozzle is positioned below the evaporative media.

15. The evaporative cooling module of claim 12, further comprising a door positioned on a side surface of the frame for accessing the evaporative media.

16. The evaporative cooling module of claim 12, further comprising a solenoid that opens and closes when instructed to do so to permit water to flow through the spray nozzle.

17. The evaporative cooling module of claim 12, wherein the spray nozzle is made at least in part of Teflon and the spray nozzle is sized to cover the evaporative media with water.

18. The evaporative cooling module of claim 12, wherein the spray nozzle is shaped to spray in a 120° fan shape.

19. The evaporative cooling module of claim 12, wherein the evaporative media is about 1" thick.

20. The evaporative cooling module of claim 19, wherein the evaporative media is dual density, with a density of the downstream side of the media being lower than a density of the upstream side of the media.

* * * * *